United States Patent [19]

Miller

[11] 3,951,077

[45] Apr. 20, 1976

[54] RAILWAY HOPPER CAR DOOR AND LATCH ACTUATING MEANS

[75] Inventor: Roy W. Miller, Highland, Ind.

[73] Assignee: Pullman Incorporated, Chicago, Ill.

[22] Filed: Mar. 13, 1975

[21] Appl. No.: 558,086

[52] U.S. Cl. ..... 105/241 C; 105/308 P; 214/58; 214/63

[51] Int. Cl.[2] ..... B61D 7/04; B61D 7/06; B61D 7/18; B61D 7/30

[58] Field of Search ..... 105/241 C, 250, 251, 105/252, 286, 308 P, 304; 214/58, 63

[56] References Cited

UNITED STATES PATENTS

| | | | |
|---|---|---|---|
| 449,524 | 3/1891 | Cooper | 214/63 |
| 1,213,327 | 1/1917 | Baker | 214/63 |
| 1,266,630 | 5/1918 | Ross et al. | 214/63 |
| 1,607,035 | 11/1926 | Andrews | 214/63 |
| 1,803,384 | 5/1931 | Dietrichson | 214/58 |
| 1,876,637 | 9/1932 | Dietrichson | 214/63 |
| 2,374,155 | 4/1945 | Pancake | 214/63 |
| 3,314,558 | 4/1967 | Dorey | 105/304 X |
| 3,405,656 | 10/1968 | Dorey | 105/214 C X |
| 3,459,317 | 8/1969 | Shaver | 105/304 X |
| 3,515,076 | 6/1970 | Aquino | 105/251 |
| 3,606,041 | 9/1971 | Schuller | 214/63 |
| 3,606,042 | 9/1971 | Schuller | 214/63 |
| 3,606,043 | 9/1971 | Miller | 214/63 |
| 3,773,194 | 11/1974 | Schuller | 214/63 |
| 3,872,796 | 3/1975 | Adler et al. | 105/241 C |

*Primary Examiner*—Albert J. Makay
*Assistant Examiner*—Howard Beltran
*Attorney, Agent, or Firm*—Richard J. Myers

[57] ABSTRACT

A railway hopper car having bottom dump discharge openings include a bell crank arm which is pivoted by a camming arrangement positioned adjacent to track to an opened position whereby a load is discharged. An auxiliary latch is provided which in the normal operating condition of the train locks the arm against rotation to prevent opening of the doors. The camming device includes an arrangement which is first engaged by an auxiliary latching element which is moved to a release position whereby a cam follower engages the camming face of a cam to thereby pivot the bell crank to its open position.

7 Claims, 5 Drawing Figures

RAILWAY HOPPER CAR DOOR AND LATCH ACTUATING MEANS

A related patent application is Ser. No. 415,098 filed Nov. 12, 1973 now U.S. Pat. No. 3,872,796, issued Mar. 26, 1975.

BACKGROUND OF THE INVENTION

1. Field of the Invention

The present invention relates to railway hopper cars for transporting material such as coal, iron ore, etc. having bottom discharge openings which are actuated by means of devices positioned remote from the car adjacent to the track.

2. Description of the Prior Art

Devices for actuating railway car hopper doors from devices placed adjacent to the track on which the railway car is being transported are shown in U.S. Pat. Nos. 1,266,630 May 21, 1918; 1,803,384 May 5, 1931; 3,314,558 Apr. 18, 1967; 3,459,317 Aug. 5, 1969.

SUMMARY OF THE INVENTION

The present invention relates to an improved bottom door opening structure for actuating the discharge doors of a hopper car so that the load within the hopper car further pushes the door to its opening position and thereby discharges the load. The aforementioned patent application broadly discloses a hopper car having bottom discharge doors which are actuated to open and closed positions by means of bell crank lever having located thereon roller cams or followers which are engaged by on-track cams for opening and closing the doors. The present invention related to an improvement in an auxiliary locking device which during the transit position of the railway car, prior to its reaching its point of destination, provides an effective and secure lock preventing any accidental or undesired movement of the door actuating mechanisms. An opening cam is positioned adjacent a track on which the railway car travels and a similar cam is placed on the other side so that in effect both of the doors are opened simultaneously, one from each side of the track. The cams are engaged by the cam followers and subsequent to such engagement an auxiliary locking device is displaced vertically about a pivot bracket and is thereby disengaged from locking relation with respect to the bell crank lever of the actuating mechanism. This is achieved by a rod supported on the upper surface of the cam, the rod being initially engaged to effectuate the raising of the latch thereby disengaging the same just prior to the opening action of the cam follower which is then in engagement with the opening cam.

The cam structure which is placed adjacent the track is also readily movable to a non-use position since the pedestal supporting the cam is hingedly connected to a base and to a diagonal which may be easily disengaged so that the entire arrangement can then be placed on the ground in an out of the way position.

DESCRIPTION OF THE PREFERRED EMBODIMENT

Figures 1, 2, 5:
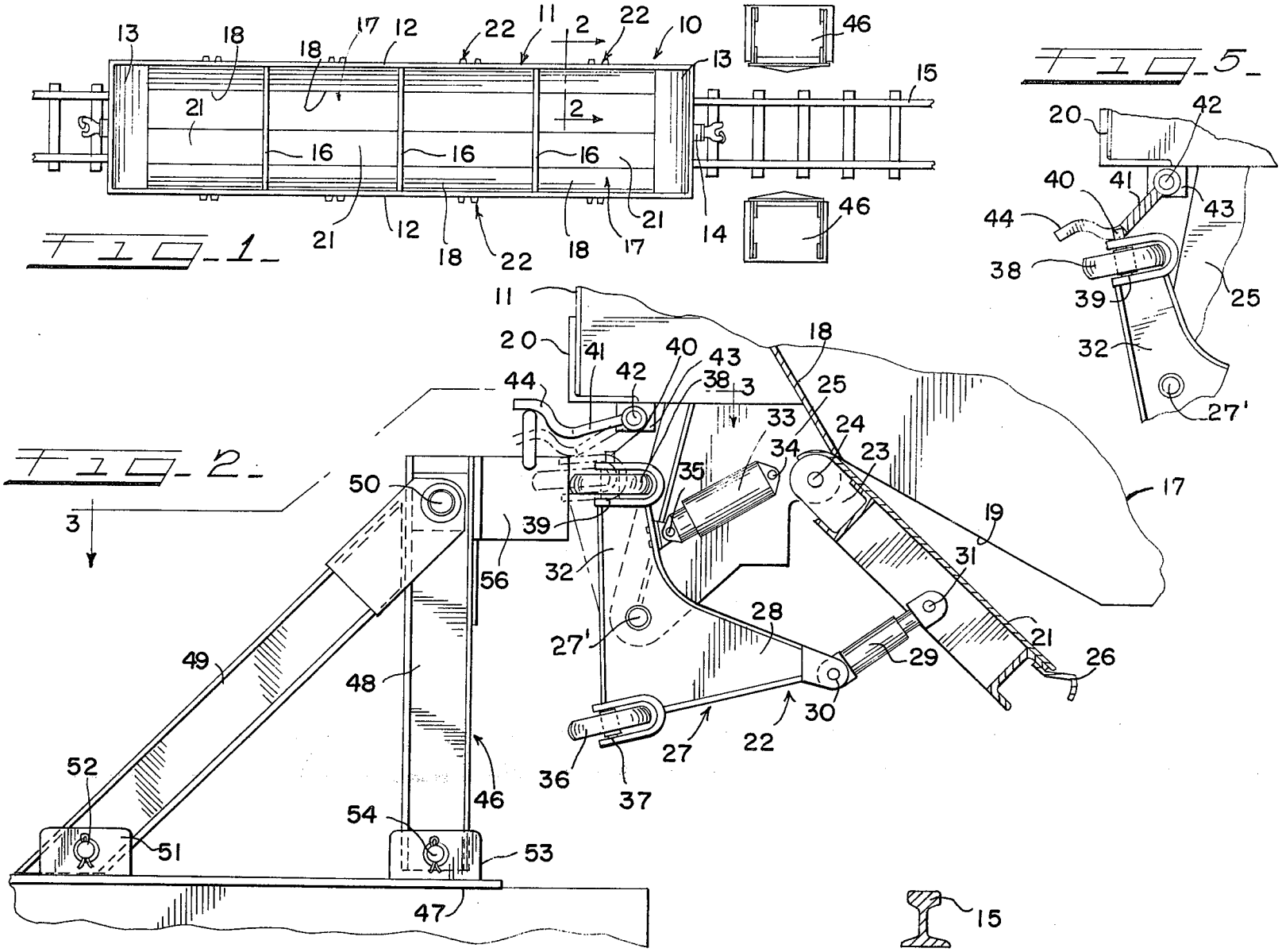
FIG. 1 is a plan view of a railway hopper car positioned on a track disclosing in general a bottom door discharge arrangement.
FIG. 2 is a large cross-sectional view taken substantially along the line 2—2 of FIG. 1 showing an improved track side cam arrangement and door actuating means.
FIG. 5 is a detail view of a latch element.

A railway hopper car 10, shown in FIG. 1, includes a body 11 provided with sidewalls 12 having connected thereto sloping end walls 13. The car 10 includes a conventional underframe supported on trucks and conventional couplers 14. The car 10 is supported on a railway track 5 and is provided interiorly thereof with a plurality of vertically extending divider walls 16 providing a plurality of hopper structures 17. Each of the hopper structures 17 also includes sloping hopper walls 18 shown in FIGS. 1 and 2. Opposite sides of the car are provided with conventional longitudinal extending side sills 20. Each of the hopper structures 17 is provided at the lower end thereof with hopper doors 21 which regulate a discharge opening 19 provided at the lower portions of the sloping hopper walls 18.

A door actuating mechanism for regulating the hopper doors is generally indicated at 2—2, each of set mechanisms being provided for regulating each door of the pair of doors positioned on opposite sides of the hopper car body. Each of the hopper doors 21 is provided with a hinge bracket 23 connected by means of a pivot shaft arrangement 24 to a bracket structure 25 provided on the opposite sides of the body 11. The door 21 is also provided with an end seal 26 adapted to suitably engage with another of such seals on the other door of the particular hopper structure 17. Each of the door actuating mechanisms 22 is provided with a bell crank lever or arm 27 pivotally connected to bracket structure 25 by pin 27' and having a laterally extending arm portion 28. A link 29 is pivotally connected to the arm portion 28 by means of a pivot 30 and extends laterally to a pivot connection 31 with the door 21. The bell crank lever 27 is also provided with a vertically extending or upright arm portion 32 having connected thereto a spring actuated link element 33 pivotally connected at 34 to the bracket structure 25 and also pivotally connected at 35 to the upright arm portion 32. The function of the link element 33 is more specifically described in aforementioned patent application.

Figure 3:
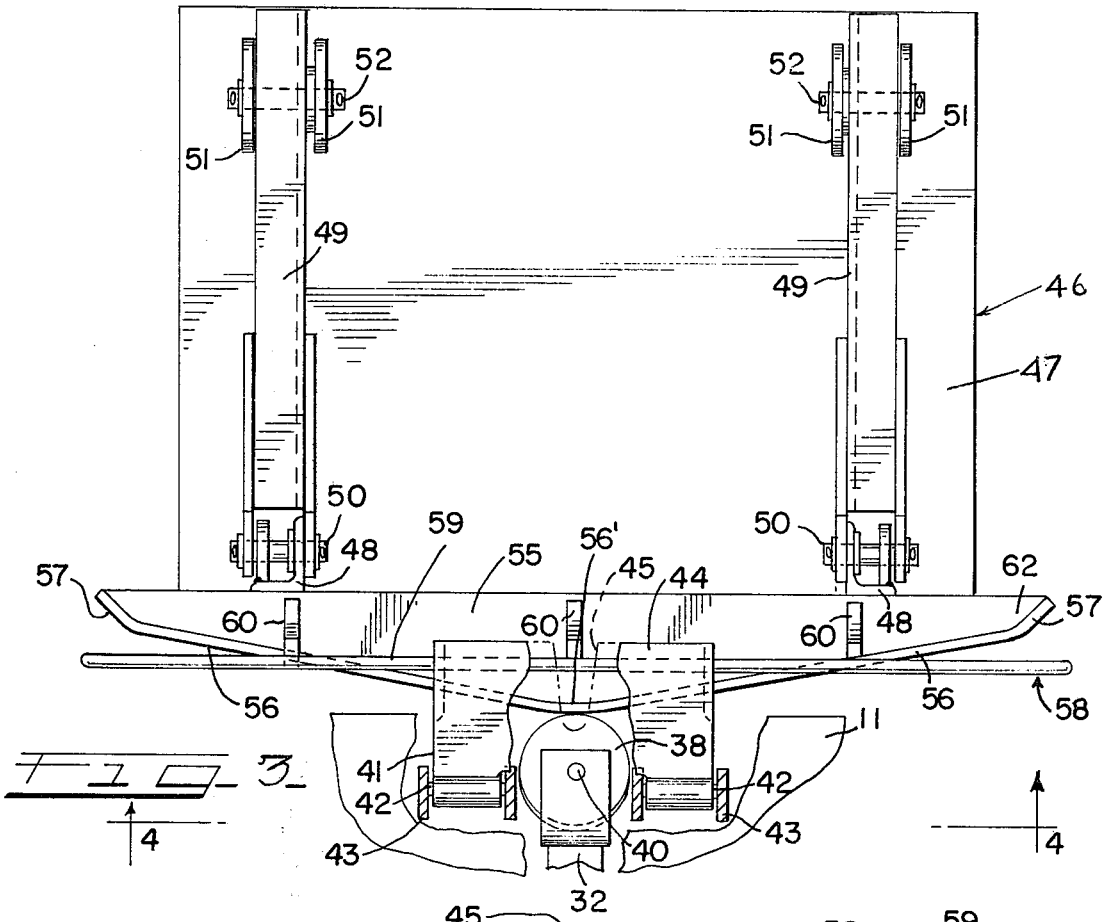
FIG. 3 is a cross-sectional view taken substantially along the line 3—3 of FIG. 2.

As best shown in FIG. 2, the lower end of the arm portion 32 is provided with a roller structure or cam follower means 36 pivotally mounted on a shaft 37 carried by the lower end of said arm 32. The upper end of the arm 32 is also provided with a similar roller structure or cam follower means 38 in turn journalled on a shaft 39. Substantially concentric with the shaft 39 is a vertically extending lock projection or stud 40. An auxiliary lock or latch element is designated at 41 and includes pivot means 42, as best shown in FIG. 3, which are journalled on brackets 43 rigidly secured to the body 11. The auxiliary lock or latch element 41 is provided with a curved end plate portion 44 having, as shown in FIG. 3, a V-shaped notch 45. In the lower engaged position of the latch 41 the notch 45 is disposed in engagement with the lock projection 40 thereby preventing rotation of the bell crank lever 27 with respect to the support 25.

As best shown in FIGS. 1 through 4, a cam structure 46 is positioned on opposite sides of a track 15, the same being positioned to be engaged by the roller structure 38 for moving the doors 21 to an opening position. The cam structure 46 includes a base 47 having disposed thereon a pair of upright pedestals 48. Diagonal beams 49 are connected to the upper ends of the pedestals 48 by means of removable pins 50. As best shown in FIGS. 2 and 3, the lower ends of the diagonal beams 49 are connected by means of upright brackets 51 to the base 47 by means of removable pins 52. The vertical pedestals 48 in turn are removably and pivotally connected to brackets 53 by means of removable pins 54, the said brackets 53 being rigidly secured to the base 47.

Figure 4:
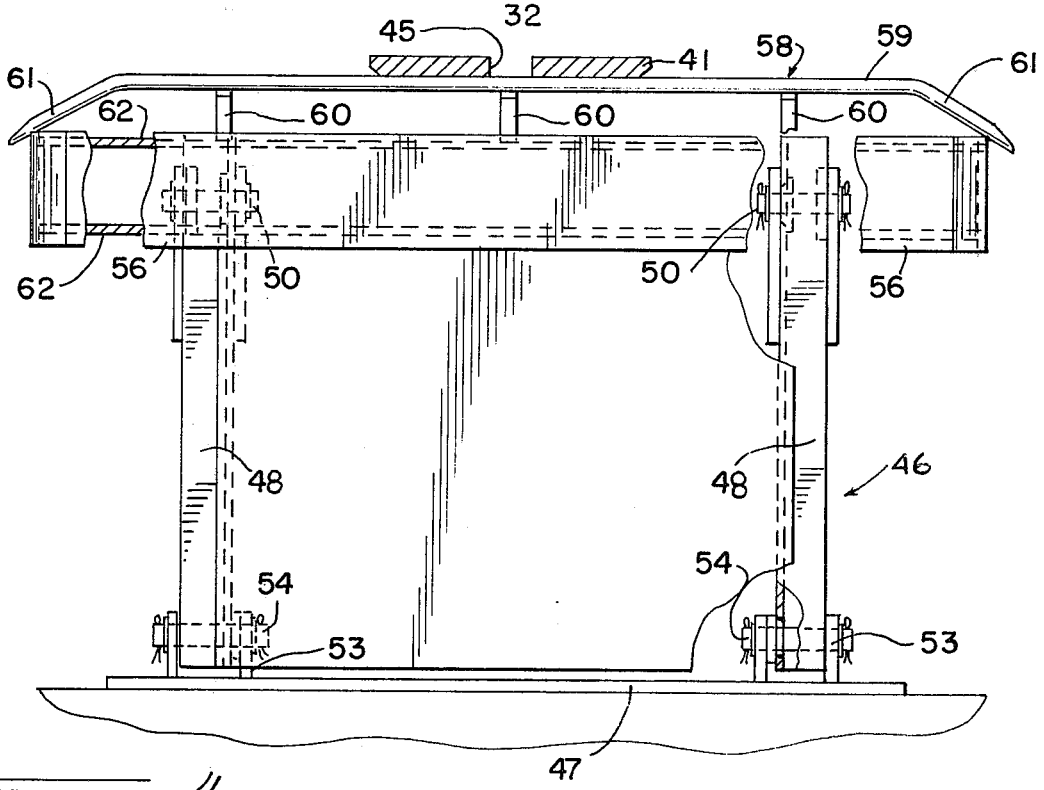
FIG. 4 is a cross-sectional view of a camming device located adjacent a track taken substantially along the line 4—4 of FIG., 3.

As best shown in FIGS. 3 and 4, a horizontally disposed cam is designated at 55 and includes substantially vertical diagonally extending cam faces 56 which meet at an outermost apex portion 56' as best shown in FIG. 3. The opposite ends of the cam 55 are provided with diagonally extending cam faces 57. A latch disengaging structure is generally designated at 58 and includes a rod 59 supported in raised position relative to the cam structure 46 by means of brackets 60 in turn supported on the inner surface of the cam 55. As best shown in FIG. 4, the rod 59 also includes at opposite ends thereof downwardly or diagonally extending end portions 61. The cam 55 also includes upper and lower plates 62, the upper of which supports the brackets 60.

THE OPERATION

The operation of the door actuating mechanisms 22 for each of the doors is more specifically described in the aforementioned patent application. As the railway car 10 approaches the cam structure 46, the latch 41 for each of the bell crank levers 27 is in position wherein the V-notch 45 is locked against the lock projection 40. This prevents the bell crank arm 27 from rotating until the auxiliary lock is moved to an open position. As the car is moving past the cam structure 46, each of the plate portions 44 are initially moved upwardly along one of the diagonal end portions 61 of the rod 59 and is thereby immediately raised free of the lock projection 40. The continuing longitudinal surface of the rod 59 keeps the latch 41 in its raised position so that the bell crank lever 27 can now be opened. As the lever 27 travels along one of the surfaces 56, the follower 38 is in rolling engagement with one of the surfaces 56, and when the apex 56' is reached, the upper end of the arm 32 is forced inwardly into its maximum position, in turn causing the bell crank lever 27 to move to over-center position thereby cracking the door 21.

The weight of the material within the car now pushes the hinged doors to an open position and the material is discharged. As the railway car moves further down the track, suitable camming means is provided which is engaged by the follower 36 to again actuate the lever 27 to pivot the doors to their locked position whereupon the latches 41 are again able to assume their engaged positions. This is also further described in the aforementioned patent application.

Thus it is clear that an effective lock has been provided which is positively displaced from locking position when the door is ready for opening and the actuating mechanism is actuated. By virtue of the pinned arrangement of the upright pedestals and the diagonal beams to the base and to each other, it is apparent that the pins can readily be removed so that the cam may be moved to a non-use position. This can be simply achieved by removing the pins 52 and folding the pedestals to one side of the ground. Thus a multiplicity of cams of this type may be placed in position at certain pit areas where it is desired that the load be discharged.

What is claimed is:

1. For a railway hopper car having a body structure and a hopper and bottom dump door means for discharging materials from said hopper, door actuatinng mechanism for moving said door means between open and closed positions including a bell shaped crank arm pivotally mounted on said structure and having an arm portion pivotally connected to said door, cam follower means are solid arm, the improvement comprising a cam structure positioned adjacent a railway track on which said car is travelling, said structure including a base having an upright pedestal, a horizontally extending cam member supported on said pedestal and including a vertical cam surface adapted to be engaged by said cam follower means, a latching element movably connected to said body structure, a latch engageable element on said crank arm, said latch element in one position engaging said engageable element to lock said arm in a position wherein said door means is closed, disengaging means on said cam structure engaging said latching element during movement of said car to initially disengage the same from latch engageable element, and said cam follower means then engaging said vertical cam surface to move said crank arm whereby said door means is released to an open position.

2. The invention in accordance with claim 1, said pedestal being movably connected to said base whereby the same may be rotated to an inoperative position.

3. The invention in accordance with claim 2, including a diagonal support member connected to said base, and means releasably connecting said diagonal support member to said pedestal.

4. The invention in accordance with claim 1, said latch element including means pivotally connecting the same to said structure, said disengaging means including an elongated horizontal member engaged by said latch member whereby the latch member is moved upwardly to a disengaged position.

5. The invention in accordance with claim 4, said latch element having a V-shaped open-end slot and said latch engageable element including a projection on said crank arm engaged in said V-shaped slot in the lock position of said crank arm.

6. The invention in accordance with claim 5, said disengaging means comprising an elongated rod-like member supported above said cam surface.

7. The invention in accordance with claim 6, said rod-like member having an upwardly inclined end portion for initially engaging said latch element.

* * * * *